United States Patent [19]

Ford

[11] 4,000,786

[45] Jan. 4, 1977

[54] MARINE MUFFLER

[75] Inventor: John R. Ford, Xenia, Ohio

[73] Assignee: Vernay Laboratories, Inc., Yellow Springs, Ohio

[22] Filed: Nov. 3, 1975

[21] Appl. No.: 628,378

[52] U.S. Cl. ..... 181/52; 181/57

[51] Int. Cl.[2] ..... F01N 1/08

[58] Field of Search ..... 181/39, 49, 51, 52, 181/56–57, 63, 68–70

[56] References Cited

UNITED STATES PATENTS

| | | | |
|---|---|---|---|
| 981,770 | 1/1911 | Kreis | 181/63 |
| 1,096,970 | 5/1914 | Unke et al. | 181/70 X |
| 2,416,452 | 2/1947 | Marx | 181/57 X |
| 2,511,597 | 6/1950 | Marx | 181/68 X |
| 2,516,948 | 8/1950 | Bourne | 181/70 X |
| 3,177,971 | 4/1965 | Kelly | 181/52 |
| 3,220,506 | 11/1965 | Vernet | 181/52 |
| 3,448,824 | 6/1969 | Conard | 181/52 |

*Primary Examiner*—Lawrence R. Franklin
*Attorney, Agent, or Firm*—Biebel, French & Nauman

[57] ABSTRACT

A reactive type marine muffler which combines principles of both baffled construction and expansion chamber attenuation with a liquid flow path to provide improved sound attenuation over a broad spectrum of octave bands and a substantially lower dB(A). The baffles are preferably dome-shaped with their apices directed counter to the flow through the muffler and the expansion chambers are interconnected by a connecting tube mounted in a median baffle and projecting into adjoining expansion chambers.

3 Claims, 4 Drawing Figures

MARINE MUFFLER

BACKGROUND OF THE INVENTION

Acoustical mufflers are generally of the absorptive or reactive type with the reactive type mufflers relying upon self-destruction of the sound waves through reflection or expansion.

Additionally, where the muffler is of the marine type provision is usually made for directing at least a portion of the engine coolant through the exhaust system.

In the reactive type mufflers the construction will usually take the form of either a plurality of interconnected expansion chambers or a series of baffles positioned within the flow path of the exhaust gases to attenuate engine noise.

Typical of the expansion chamber type muffler designs are those shown in U.S. Pat. Nos. 2,511,190; 2,516,948; 3,077,240; 3,080,939; 3,101,811; 3,177,971; and 3,448,824. Of interest with regard to baffle type mufflers are U.S. Pat. Nos. 2,485,555; 2,933,148; and 3,220,506.

The latter patent is assigned to the assignee of the present application and has found wide scale commercial use, although in its present commercial form the baffles are reversed with respect to the flow of fluid through the muffler from the direction shown in the patent.

Despite the variety of muffler designs which presently exist, many of them for marine use and some, such as applicant's present commercial design, having met with substantial commercial success, a need still exists for a marine muffler which will provide improved sound attenuation over a substantially broad spectrum and with a substantially lower dB (A).

SUMMARY OF THE INVENTION

In accordance with the present invention a muffler has been designed which incorporates both the expansion chamber principles of muffler design with a baffled construction in a unique combination which has been found to provide superior sound attenuation and a significantly lower dB (A).

A muffler in accordance with the present invention includes a main body section which is divided into upstream and downstream expansion chambers by a median baffle which supports a connecting tube projecting into and interconnecting the upstream and downstream expansion chambers.

Inlet and outlet caps are provided at upstream and downstream ends, respectively, of the muffler, each of the caps including a narrow section, a relatively wider section attached to the ends of the main body section and a tapered connecting section.

Positioned within the muffler are dome-shaped baffles, an outlet baffle mounted in the downstream end of the main body section of the muffler and projecting into the downstream expansion chamber and an inlet baffle mounted in the upstream end of the main body section and projecting outwardly thereof into the inlet cap.

The dome-shaped inlet and outlet baffles have relatively large openings therethrough to permit the passage of both liquids and gases while the median baffle has a restricted opening therethrough which, during normal operations, that is, conditions other than relatively low engine speeds, remains flooded with liquid while exhaust gases pass from the upstream expansion chamber to the downstream expansion chamber through the connecting tube.

The median baffle may assume different configurations with regard to sound attenuation effectiveness but from the view point of simplicity of manufacturing, the median baffle may be of the same overall configuration as the inlet and outlet baffles, the median baffle being modified only insofar as necessary to accommodate the connecting tube and to provide a liquid passage therethrough of relatively restricted cross-sectional area.

DESCRIPTION OF THE PREFERRED EMBODIMENT

Figure 1:
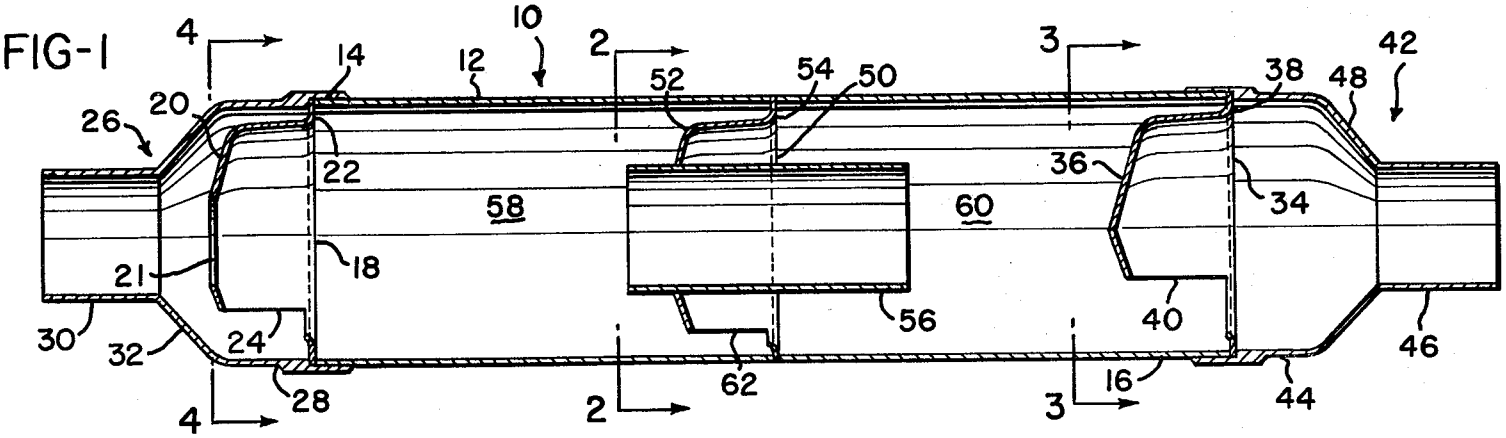
FIG. 1 is a longitudinal, cross-sectional view of a marine muffler in accordance with the present invention.
Figure 4:
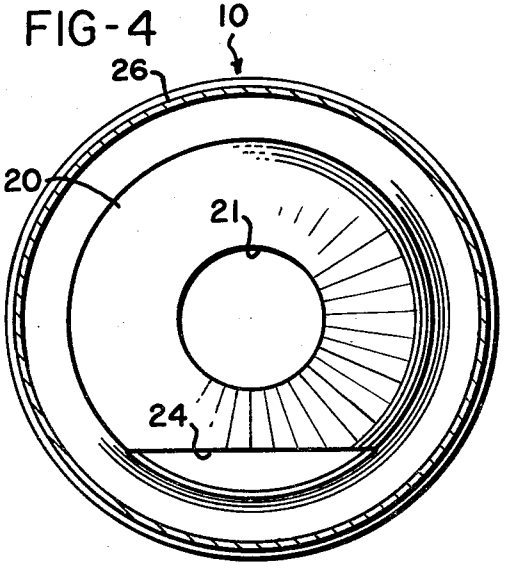
FIG. 4 is a cross-sectional view taken on line 4—4 of FIG. 1.
Figure 3:
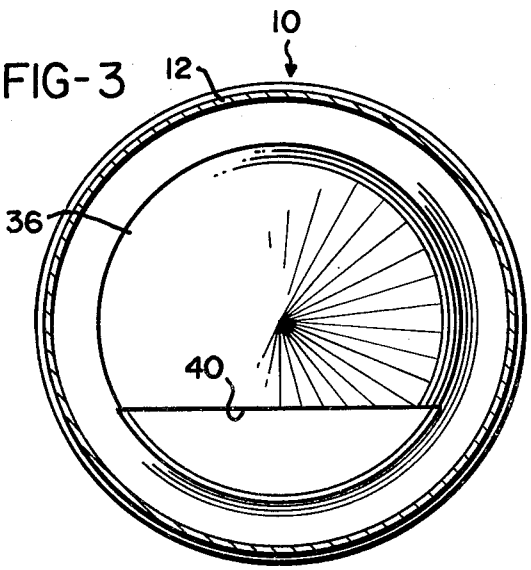
FIG. 3 is a cross-sectional view taken on line 3—3 of FIG. 1.
Figure 2:
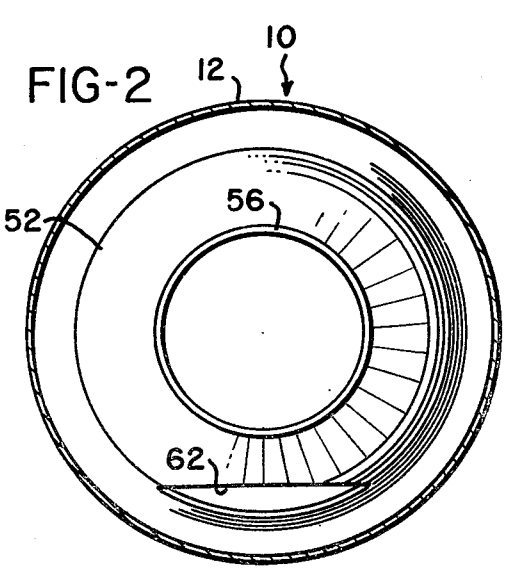
FIG. 2 is a cross-sectional view taken on line 2—2 of FIG. 1.

As seen in the drawings, the muffler 10 of the present invention includes a tubular main body section 12 which may be of circular, cylindrical configuration and have an inlet adjacent its upstream end 14 and an outlet adjacent its downstream end 16.

An inlet baffle 18 is mounted in the upstream end of the main body section 12 and consists of a substantially dome-shaped central portion 20 having an opening 21 formed therethrough and a flange 22 projecting outwardly from the domed central portion. The lower portion of the inlet baffle 18 is cut away, as at 24, to provide an opening through the baffle for the passage of both liquids and gases.

An inlet cap 26 is mounted over the upstream end of the main body section 12 and includes a downstream end 28 of substantially the same cross-sectional configuration as the upstream end 14 of the main body section, an upstream end 30 of substantially reduced cross-sectional configuration and a tapered section 32 interconnecting the portions 28 and 30. With the above construction it will be seen that the inlet baffle 18 is such that the apex of its dome-shaped portion 20 projects in an upstream direction into the inlet cap 26.

A similar construction prevails adjacent the downstream end 16 of the main body section where an outlet baffle 34 is mounted having a dome-shaped portion 36 and a flange 38. Although the dome 36 of baffle 34 is imperforate, in contrast to the inlet baffle 18, a substantial portion of the outlet baffle 34 is cut away, as at 40, to accommodate the passage of both liquids and gases through the outlet baffle. Preferably the cut away portion 40 is larger than the cut away portion 24 of the inlet baffle 18.

An outlet cap 42, which may be identical to the inlet cap 26, is secured over the downstream end 16 of the main body section and includes a portion 44 of substantially the same cross-sectional configuration as the downstream end of the main body section and secured thereto, a portion 46 of substantially reduced cross-sectional configuration, and a tapered interconnecting portion 48.

Mounted in the main body section 12 intermediate its upstream and downstream ends is a median baffle 50 similar in construction to the inlet and outlet baffles 18 and 34. Thus, the median baffle includes a dome-shaped central portion 52 and a flange 54.

However, the median baffle 50 is apertured and receives a connecting tube 56 which projects through the median baffle and into an upstream expansion chamber 58 and a downstream expansion chamber 60. Additionally, an opening provided by a cut away portion 62 in the median baffle is of substantially restricted area as compared to the openings through the inlet and outlet baffles 18 and 34.

With this design the opening 62 through the median baffle remains substantially flooded with liquid under normal operating conditions, that is, at other than very low engine speeds, while exhaust gases pass from the upstream expansion chamber 58 to the downstream expansion chamber 60 through the connecting tube 56.

In the above construction it will be noted that the apex of each of the three dome-shaped baffles projects in an upstream direction, with the inlet baffle 18 projecting into the inlet cap 26, the median baffle 50 projecting into the upstream expansion chamber 58 and the outlet baffle 34 having its apex projecting into the downstream expansion chamber 60.

With the above construction comparative tests have shown superior sound attenuation over a relatively broad octave band and a lower dB (A) level.

While the form of apparatus herein described constitutes a preferred embodiment of the invention, it is to be understood that the invention is not limited to this precise form of apparatus, and that changes may be made therein without departing from the scope of the invention.

What is claimed is:

1. A marine muffler comprising:

an elongated, substantially tubular main body section, a pair of apertured end caps mounted over opposite ends of said main body section and defining an inlet and an outlet thereto, a plurality of substantially similar, dome-shaped baffles mounted in said main body section in spaced relationship to each other, each of said similar, dome-shaped baffles including a dome-shaped central portion having an apex thereof projecting toward said inlet of said main body section and a flange projecting outwardly from said dome-shaped central portion, a first of said baffles positioned adjacent said inlet to said main body portion having a first opening formed through said dome-shaped central portion thereof and a lower, cut away portion adjacent said flange thereof, a second of said dome-shaped baffles being positioned adjacent said outlet from said main body section and having cut away portion adjacent said flange thereof, a third one of said dome-shaped baffles being mounted in said main body section intermediate said first and second dome-shaped baffles and dividing said main body section into upstream and downstream expansion chambers, means defining an opening through the apex of said third dome-shaped baffle and a cut away portion adjacent the flange thereof, and a substantially cylindrical connecting tube mounted within said opening in said third one of said dome-shaped baffles and projecting into said upstream and downstream expansion chambers.

2. The muffler of claim 1 wherein:

said cut away portion of said second one of said baffles is substantially greater than said cut away portion of said first one of said baffles.

3. The muffler of claim 1 wherein:

said cut away portions of said first and second dome-shaped baffles are substantially larger than said cut away portion of said third dome-shaped baffle.

* * * * *